US006014542A

United States Patent [19]

Hozumi et al.

[11] Patent Number: 6,014,542

[45] Date of Patent: Jan. 11, 2000

[54] IMAGE FORMATION SYSTEM

[75] Inventors: Shinji Hozumi; Takashi Abe; Hiroaki Fujikura, all of Ebina, Japan

[73] Assignee: Fuji Xerox Co., Ltd., Tokyo, Japan

[21] Appl. No.: 09/218,160

[22] Filed: Dec. 22, 1998

[30] Foreign Application Priority Data

Jan. 5, 1998 [JP] Japan ..... 10-000024

[51] Int. Cl.[7] ..... G03G 15/00

[52] U.S. Cl. ..... 399/394; 399/396

[58] Field of Search ..... 399/394, 396, 399/388, 381, 75, 76, 78; 271/264, 265.01, 265.02, 266, 270

[56] References Cited

U.S. PATENT DOCUMENTS

| | | | |
|---|---|---|---|
| 4,519,700 | 5/1985 | Barker et al. | 399/394 |
| 5,043,771 | 8/1991 | Shibata et al. | 399/396 |
| 5,057,874 | 10/1991 | Miyazaki et al. | 399/396 |
| 5,119,146 | 6/1992 | Nobumori et al. | 399/396 |
| 5,140,379 | 8/1992 | Johnson | 399/394 X |
| 5,440,382 | 8/1995 | Suga | 399/394 |

FOREIGN PATENT DOCUMENTS

| | | |
|---|---|---|
| 62-208065 | 9/1987 | Japan . |
| 4-264569 | 9/1992 | Japan . |
| 4-282652 | 10/1992 | Japan . |
| 5-85644 | 4/1993 | Japan . |
| B2-6-93145 | 11/1994 | Japan . |

*Primary Examiner*—Matthew S. Smith
*Assistant Examiner*—Hoan Tran
*Attorney, Agent, or Firm*—Oliff & Berridge, PLC

[57] ABSTRACT

An image formation system includes: a paper transport unit transporting paper along a paper transport passage; an image formation unit forming an image on an image carry belt; an image sense unit sensing a position of the image formed on the image carry belt; a transfer unit transferring the image formed on the image carry belt to the paper transported by the paper transport unit; a paper passage sense unit sensing paper passage on the paper transport passage, the paper passage sense unit being disposed upstream from a position where the image is transferred by the transfer unit; and a control unit controlling paper transport speed of the paper transport unit based on the sense results of the image sense unit and the paper passage sense unit.

7 Claims, 7 Drawing Sheets

IMAGE FORMATION SYSTEM

BACKGROUND OF THE INVENTION

1. Field of the Invention

This invention relates to an image formation system such as a copier using electrophotography.

2. Description of the Related Art

Generally, an image formation system using electrophotography forms an electrostatic latent image corresponding to an image signal on a photosensitive body, develops the electrostatic latent image to a toner image, and transfers the toner image to paper, then fixes the toner image on the paper.

Known as this type of image formation system is an image formation system adopting a transport form for feeding paper into an image transfer position of a photosensitive body or an intermediate transfer body by means of a registration roller placed before the transfer position (upstream of paper transport passage).

The image formation system adopting the transport form catches paper transported from the upstream side of the paper transport passage in the space between the registration roller and a pinch roller for pressing against the registration roller and rotates the registration roller in this state, thereby feeding the paper into the image transfer position. At the time, if a gap occurs between the paper arrival timing at the image transfer position and the image arrival timing, the image transfer position on the paper shifts from a desired position; particularly to transfer an image to the full face of paper, margin dimensions become non uniform, etc., leading to extremely poor appearance.

Hitherto, the actual image arrival time at the transfer position, which will be hereinafter referred to as the ideal time, has been calculated based on the image (latent image) write start timing to a photosensitive body. The paper transport speed has been controlled matching the ideal time, whereby the image (toner image) arrival timing at the image transfer position has been matched with the paper arrival timing.

By the way, in recent years, a so-called secondary transfer method, etc., adopting a belt-like body as a photosensitive body or transferring toner images formed on a photosensitive body to an intermediate transfer belt before transferring to paper in batch has been often used for the purposes of improving the transfer efficiency, increasing the processing capability, and the like.

However, in case of using an image carry belt such as a photosensitive belt or an intermediate transfer belt, the belt expands or contracts due to change in temperature, humidity, tension, etc., thus the paper arrival timing at the image transfer position shifts from the ideal time. Since the belt expansion or contraction degree changes depending on the situation, the shift amount from the ideal time also varies. Particularly, to use a highly elastic belt or a belt having a long peripheral length, the shift from the ideal time grows. Further, a slip phenomenon occurs between a belt and a roller for driving the belt; it also becomes a factor for causing shift from the ideal time.

SUMMARY OF THE INVENTION

It is therefore an object of the invention to provide an image formation system which enables an image and paper to arrive at an image transfer position at good timing without receiving the effect of expansion or contraction of an image carry belt.

To the end, according to one aspect of the invention, there is provided an image formation system including, a paper transport unit transporting paper along a paper transport passage, an image formation unit forming an image on an image carry belt, an image sense unit sensing a position of the image formed on the image carry belt, a transfer unit transferring the image formed on the image carry belt to the paper transported by the paper transport unit; a paper passage sense unit sensing paper passage on the paper transport passage and being disposed upstream from a position where the image is transferred by the transfer unit, and a control unit controlling paper transport speed of the paper transport unit based on the sense results of the image sense unit and the paper passage sense unit.

In the image formation system, the image sense unit senses the position of the image formed on the image carry belt by the image formation unit and the paper passage sense unit senses paper passage on the paper transport passage, then the control unit controls the paper transport speed based on the sense results of the sense unit, for example, so as to increase the transport speed if the paper passage timing is late or slow down the transport speed if the paper passage timing is too early. Thus, it is made possible to cause the image and paper to arrive at the image transfer position of the transfer unit at good timing.

According to another aspect of the invention, there is provided an image formation system including a paper transport unit transporting paper along a paper transport passage, an image formation unit forming an image on an image carry belt, an image sense unit sensing a position of the image formed on the image carry belt, a transfer unit transferring the image formed on the image carry belt to the paper transported by the paper transport unit, a stop unit temporarily stopping the paper upstream from a position where the image is transferred by the transfer unit, and a control unit controlling paper re-transport timing of the stop unit based on the sense result of the image sense unit.

In the image formation system, the image sense unit senses the position of the image formed on the image carry belt by the image formation unit and the stop unit temporarily stops the paper upstream from the image transfer position. From this state, the control unit controls the paper re-transport timing based on the sense result of the image sense unit. Thus, it is made possible to cause the image and paper to arrive at the image transfer position of the transfer unit at good timing.

DETAILED DESCRIPTION OF THE PREFERRED EMBODIMENTS

A preferred embodiment of the invention will now be described with reference to the figures.

Figure 1:
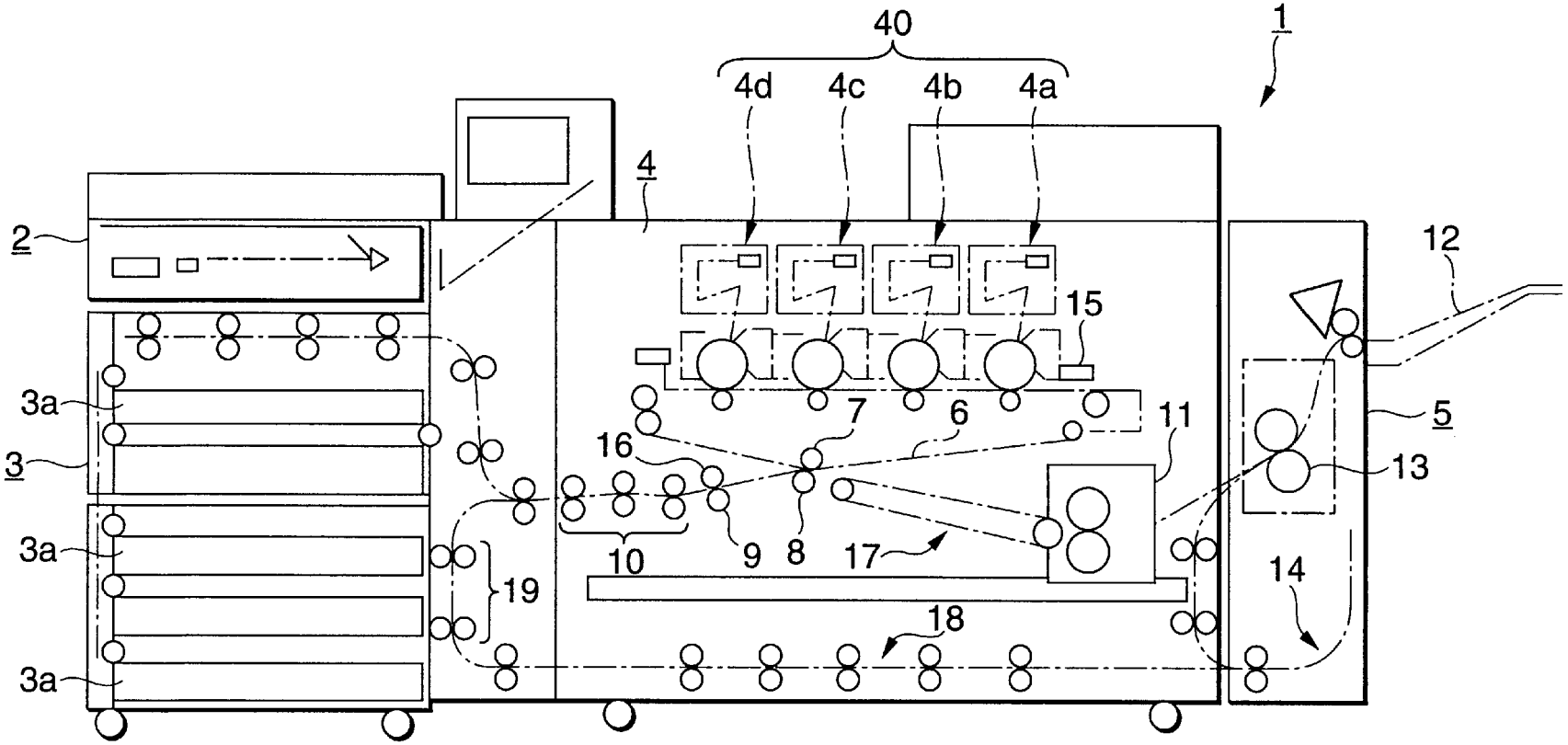
FIG. 1 is a schematic diagram showing a configuration example of an image formation system according to the invention.

FIG. 1 is a schematic diagram showing a configuration example of an image formation system according to the invention. It shows the configuration of a digital complex machine having a copy function and a printer function as an example. In FIG. 1, a digital complex machine 1 is mainly made up of an image read section 2, a paper feed section 3, an image formation section 4, and a paper discharge and inversion section 5.

The image read section 2 optically reads the image of an original placed on an original bed; for example, it consists of a light source, a reflection mirror, an image formation lens, a CCD sensor, etc.

The paper feed section 3 consists of a plurality of paper feed trays 3*a* corresponding to paper sizes and orientations (portrait and landscape) and a paper transport system for transporting paper fed out of the paper feed trays 3*a*.

The image formation section 4 forms an image on paper fed from the paper feed section 3 and has a four-drum image output unit 40 including image output sections 4*a* to 4*d*, each having of laser write, a photosensitive drum, and its peripheral devices (a charger, a developing device, a transfer device, a cleaner, etc.,), placed in a one-to-one correspondence with colors. The image formation section 4 further includes an intermediate transfer belt (image carry belt) 6 placed along the drum placement of the image output unit 40, a transfer roller 8 for pressing against a belt support roller 7 for supporting the intermediate transfer belt 6, a registration roller.9 for transporting paper to a transfer position of an image by the transfer roller 8 (contact space between the transfer roller 8 and the support roller 7), a paper alignment section 10 for aligning a side end of paper with a reference position before (upstream from) the registration roller 9, and a fuser 11 for fixing a toner image transferred to paper by the transfer roller 8.

The paper discharge and inversion section 5 has a discharge roller 13 for discharging paper with an image already formed to a stack tray 12 and an inversion section 14 for inverting paper with an image formed on one side.

With the described digital complex machine 1, toner images are formed by the image output sections 4*a*, 4*b*, 4*c*, and 4*d* of the image output unit 40 based on an image signal read through the image read section 2 or an image signal received via a network, etc. The formed toner images are transferred onto the intermediate transfer belt 6 in overlapped relation, thereby forming a color image. At the time, the image write operation onto the photosensitive drums by laser write is controlled based on the timing at which a patch, etc., disposed on the intermediate transfer belt 6 is sensed by a write reference sensor 15.

On the other hand, paper to which an image is to be transferred is fed out of the paper feed tray 3*a* selected manually or automatically, then is fed into the image formation section 4 by the paper transport system. The side end of the paper fed into the image formation section 4 is aligned with the reference position in the paper alignment section 10. Then, the aligned paper is inserted into the space between the registration roller 9 and the pinch roller 16 pressing thereagainst. As the registration roller 9 rotates, the paper is fed into the image transfer position, namely, the contact space between the belt support roller 7 and the transfer roller 8, and toner image (color image) on the intermediate transfer belt 6 is transferred to the paper.

The paper to which the toner image has thus been transferred is sent by a belt transport section 17 to the fuser 11, which then fixes the toner image.

Here, for single-sided print, the paper sent out from the fuser 11 is passed to the discharge roller 13 and is discharged to the stack tray 12 as the discharge roller 13 rotates. In contrast, for double-sided print, the paper sent out from the fuser 11 is inverted by the inversion section 14, then is sent through a horizontal transport section 18 to a paper standby section 19. The paper arrived at the paper standby section 19 temporarily stops, then is again transported at a predetermined timing and has the other side printed.

Figure 2:
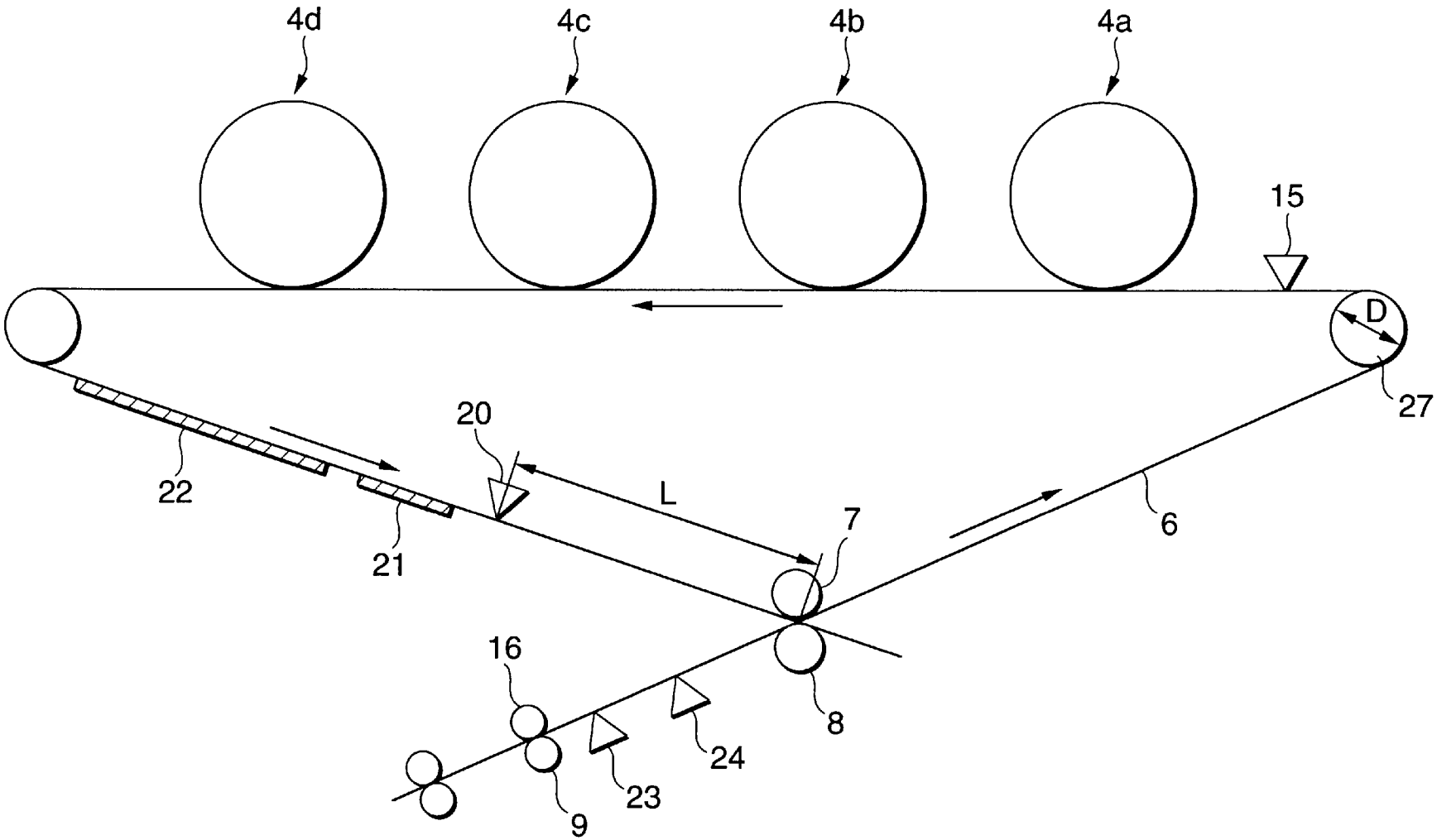
FIG. 2 is an enlarged view of the main part to show one embodiment of an image formation system according to the invention.

FIG. 2 is an enlarged view of the main part to show one embodiment of an image formation system according to the invention.

In the figure, a patch sensor 20 is disposed upstream in the belt run direction (arrow direction in the figure) from the contact space between belt support roller 7 and transfer roller 8, namely, the image transfer position by a predetermined distance L (described later).

The patch sensor 20 senses the position of an image (toner image) formed on intermediate transfer belt 6. In the system configuration example in FIG. 1, the write timing of an image 22 onto the intermediate transfer belt 6 is controlled based on the timing at which the write reference sensor 15 senses the patch 21. That is, the patch 21 is sensed by the patch sensor 20, whereby the position of the image 22 on the intermediate transfer belt 6 is sensed indirectly. Of course, the image 22 on the intermediate transfer belt 6 may be sensed directly by a sensor, etc.

On the other hand, two paper passage sensors 23 and 24 are disposed between transfer roller 8 and registration roller 9 for sensing passage of paper on the paper transport passage between the transfer roller 8 and registration roller 9. Each of the paper passage sensors 23 and 24 is made of an optical sensor, etc., including a light emitting element and a light receiving element in combination, for example. When the paper passage sensor 23, 24 senses passage (presence) of paper at its sense point, a sense signal makes an on to off state transition (or an off to on state transition). For convenience of the description, the paper passage sensor 23 near the registration roller 9 will be hereinafter referred to as "first paper passage sensor 23" and the paper passage sensor 24 near the transfer roller 8 as "second paper passage sensor 24."

In the example shown in the figure, the sensor senses the patch 21 disposed on the intermediate transfer belt 6 as the means for sensing the position of the image 22 formed on the intermediate transfer belt 6. Alternatively, for example, a sensor may sense a mark put on the intermediate transfer belt 6 or a reference hole, etc., made in the intermediate transfer belt 6.

Figure 3:
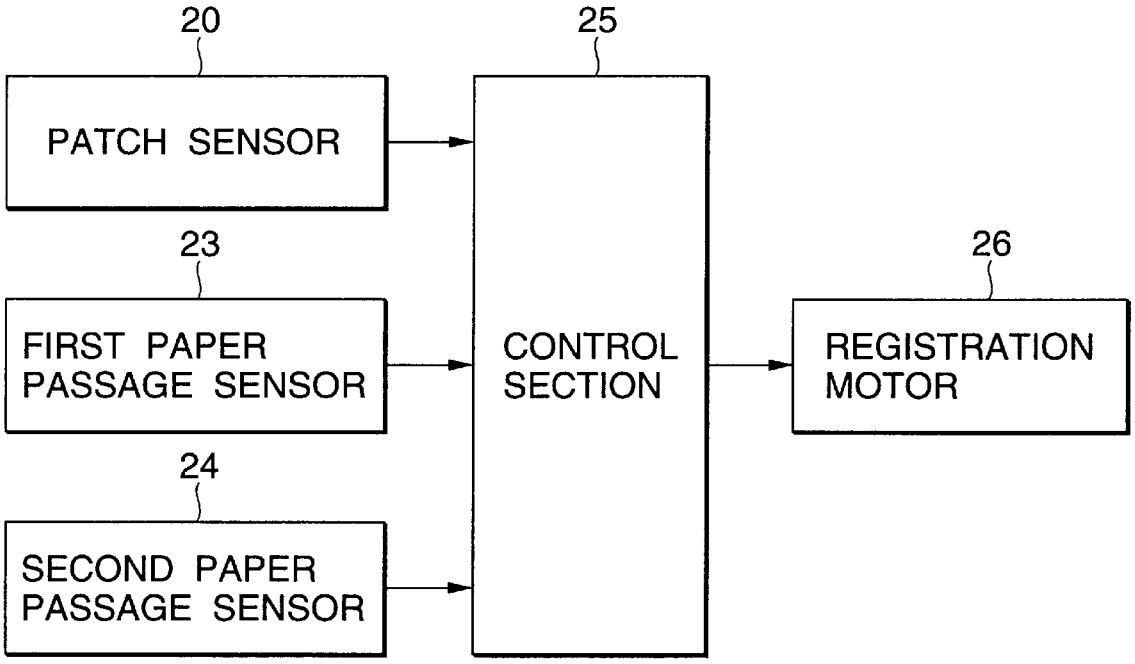
FIG. 3 is a block diagram to show the control configuration of a paper transport system in the embodiment.

FIG. 3 is a block diagram to show the control configuration of a paper transport system in the embodiment.

In the figure, sense signals of the patch sensor 20, the first paper passage sensor 23, and the second paper passage sensor 24 are input to a control section 25.

A registration motor 26 rotates the registration roller 9 for feeding paper to the image transfer position.

The control section 25 controls the processing operation of the whole image formation system according to a previously given control program. It controls the drive state of the registration motor 26 based on the sense signals input from the sensors 20, 23, and 24 in the control processing.

Figure 4:
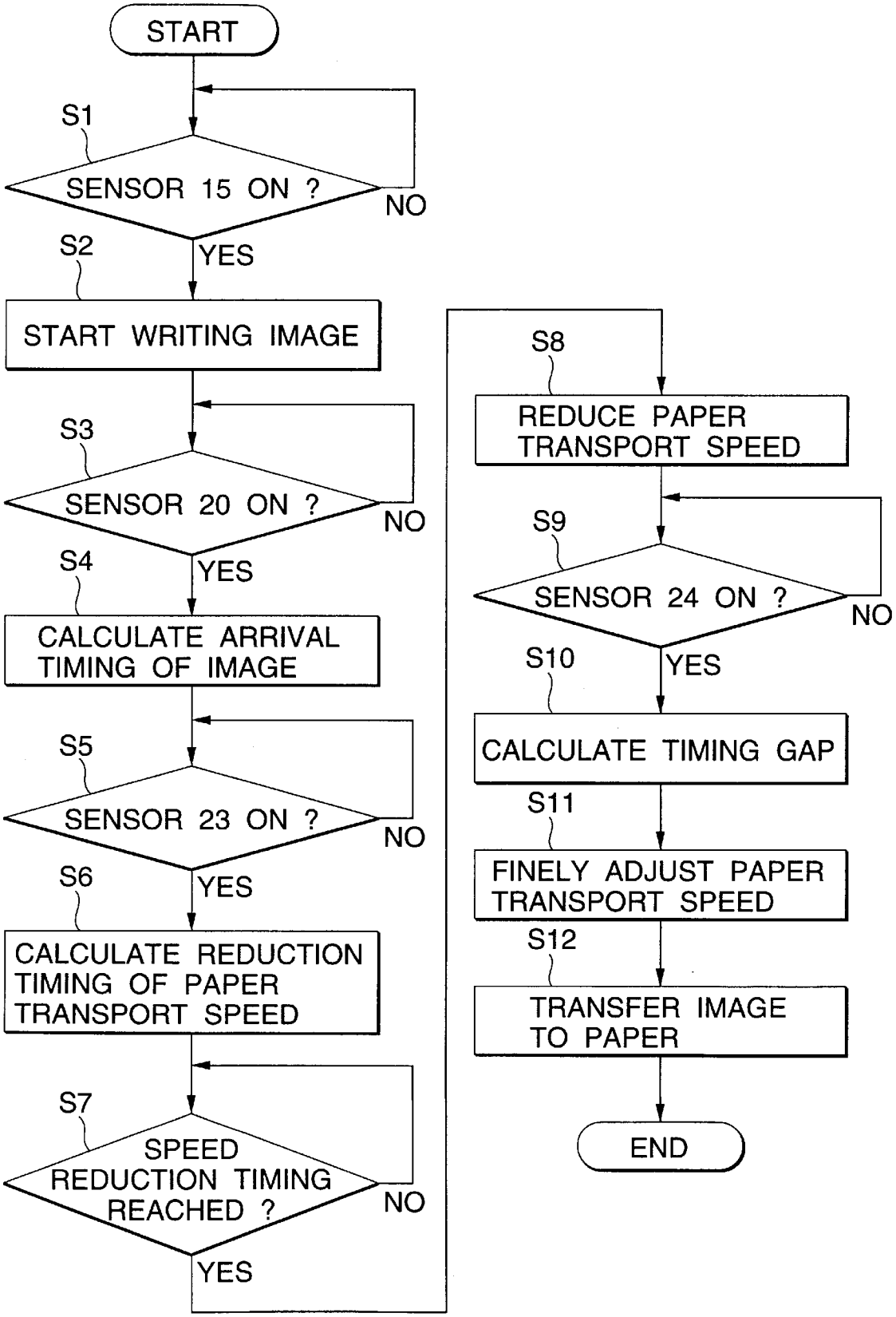
FIG. 4 is a flowchart to show a processing procedure of the image formation system in the embodiment.

FIG. 4 is a flowchart to show a processing procedure executed by the control section 25.

First, when an image formation start instruction is given, whether or not the sense signal of the write reference sensor 15 goes on is determined repeatedly at step S1. When the write reference sensor 15 senses the patch 21 on the intermediate transfer belt 6 and is turned on at step S1, image write in each image output section 4*a*–4*d* is started based on the on timing (patch sense timing) at step S2. Then, the image output sections 4*a*–4*d* transfer images (toner images) 22 onto the intermediate transfer belt 6 in overlapped relation with the position of the patch 21 as the reference.

Next, whether or not the sense signal of the patch sensor 20 goes on is determined repeatedly at step S3. When the patch sensor 20 senses the patch 21 on the intermediate transfer belt 6 and is turned on at step S3, the timing at which the image 22 on the intermediate transfer belt 6 arrives at the transfer position (contact space between the belt support roller 7 and the transfer roller 8) is calculated based on the on timing (patch sense timing) at step S4. The arrival timing of the image 22 may be calculated using the distance L between the image transfer position and the patch sensor 20 and the running speed of the intermediate transfer belt 6.

In this connection, the running speed of the intermediate transfer belt 6 can be found accurately from the time interval between the write reference sensor 15 being turned on and then again being turned on (belt turn cycle) and the peripheral length of the belt. If the distance L between the image transfer position and the patch sensor 20 is preset to an integral multiple of the peripheral length of a belt drive roller 27 (see FIG. 2) ($L=n\pi D$ where n is an integer and D is the roller diameter), the error component caused by eccentricity of the belt drive roller 27 can be decreased.

Subsequently, whether or not the first paper passage sensor 23 is turned on is determined repeatedly at step S5. When the first paper passage sensor 23 senses passage of the leading end of paper and is turned on at step S5, the timing at which the paper transport speed is reduced is calculated based on the on timing (paper passage sense timing) at step S6.

Here, on the paper transport system in the embodiment, paper on the paper transport passage from paper feed section 3 (see FIG. 1) to the registration roller 9 is transported at a high-speed level (for example, 300 mm/sec) faster than the normal process speed (transport speed applied when an image is transferred to paper, for example, 150 mm/sec). Then, before the leading edge of paper arrives at the image transfer position, the paper transport speed is restored to the process speed from the high-speed level. Thus, at step S6, the timing at which the paper transport speed is changed from the high-speed level to the process speed is calculated.

Next, whether or not the calculated speed reduction timing is reached is determined repeatedly at step S7. When the speed reduction timing is reached at step S7, the paper transport speed is reduced from the high-speed level to the process speed at step S8.

Figure 5:
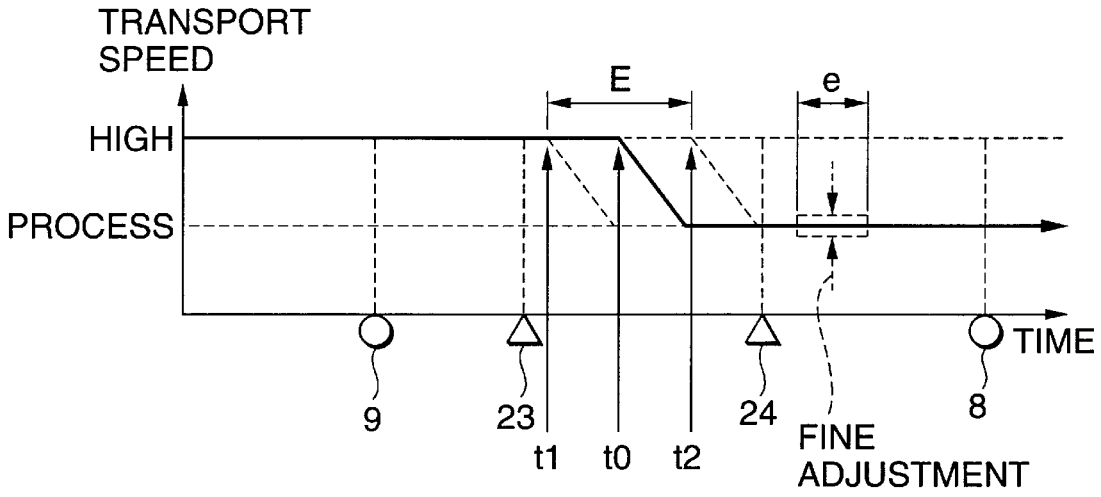
FIG. 5 is a chart to describe a control mode of paper transport speed.

Specifically, as shown in FIG. 5, a speed reduction timing adjustment area E is set for reducing the paper transport speed from the high-speed level to the process speed, and standard speed reduction timing t0 based on the image arrival timing at the image transfer position is defined in the adjustment area E (intermediate point in time).

Therefore, if the timing at which paper passes through the sense point of the first paper passage sensor 23 (sensor on timing at step S5) is early, the paper transport speed is reduced at early timing t1 accordingly; if the timing is late, the paper transport speed is reduced at late timing t2 accordingly.

Specifically, assuming that a gap between the preset ideal arrival time at the image transfer position and the arrival timing of the image 22 based on the sense timing of the patch sensor 20 is T1 and that a gap between the preset ideal arrival time at the image transfer position and the arrival timing of paper based on the sense timing of the first paper passage sensor 23 is T2, the difference between the actual reduction timing of the paper transport speed and the standard speed reduction timing t0 can be found according to the following expression:

$$\text{Speed reduction timing difference time (msec)}=T1+T2+T3$$

$$T3=(T2\cdot\sin\alpha\cdot\cos\beta)/\{\sin(\beta-\alpha)\}$$

where $\alpha$ and $\beta$ are angles applied when the paper transfer speed is expanded to a timing chart with distance on the vertical axis and time on the horizontal axis; $\alpha$ is equivalent to the angle corresponding to the normal process speed and $\beta$ is equivalent to the angle corresponding to the high-speed level faster than the process speed.

In this connection, the paper transfer speed change processing is performed by controlling the rotation speed of the registration motor 26 as a drive source of the registration roller 9.

Subsequently, whether or not the second paper passage sensor 24 is turned on is determined repeatedly at step S9. When the second paper passage sensor 24 senses passage of the leading end of paper and is turned on at step S9, a gap between the image arrival timing calculated at step S4 and the paper arrival timing is calculated based on the on timing (paper passage sense timing) at step S10. In this connection, at the point in time, the timing at which the paper transport speed is reduced by the registration roller 9 is once set with respect to the image arrival timing at the image transfer position, so that the gap between the image arrival timing and the paper arrival timing becomes minute.

Then, at step S11, the paper transport speed is finely adjusted in response to the calculated timing gap. However, since the transport speed needs to be finely adjusted before paper arrives at the image transfer position. In the embodiment, a transport speed fine adjustment area e is set and the paper transport speed is finely adjusted in the fine adjustment area e, as shown in FIG. 5.

Then, when the paper arrives at the image transfer position, the image (toner image) on the intermediate transfer belt 6 is transferred to the paper at step S12. At this time, the paper transport speed is held at the normal process speed.

Thus, in the image formation system of the embodiment, the position of the image 22 formed on the intermediate transfer belt 6 is sensed by the patch sensor 20 and the timing at which the image 22 arrives at the transfer position is found from the sense result. On the other hand, paper passage on the paper transport passage is sensed by the first paper passage sensor 23 and the paper transport speed reduction timing (paper transport speed change timing from high-speed level to process speed) is adjusted based on the comparison result between the sense timing and the image arrival timing. Thus, even if the intermediate transfer belt 6 expands or contracts, the image 22 on the intermediate transfer belt 6 and the paper transported by the registration roller 9 can be made to arrive at the image transfer position at the ideal timing.

Since the paper transport speed is finely adjusted based on the sense result of the second paper passage sensor 24 after the paper transport speed reduction timing is adjusted, the following advantage is also provided: If the paper transport speed is reduced rapidly, large minus acceleration temporarily occurs and causes a slip to occur between paper and the registration roller 9. In contrast, the frictional resistance on the paper surface varies depending on the type of paper actually used. Thus, if the paper transport speed is reduced under the same condition, an error occurs in the paper transport distance because of the frictional resistance difference. In addition, an error also occurs in the paper transport distance because of an increase or decrease in the roller diameter due to ambient temperature and change with time, eccentricity of the roller, etc. Even if such a paper transport distance error is at a slight level, it can introduce a big problem if higher image quality and higher precision are to be realized. Therefore, such a problem can be solved by finely adjusting the paper transport speed as described above.

Further, the distance between the image transfer position to the first paper passage sensor 23 is set to an integral multiple of the peripheral length of the registration roller 9, whereby the error component caused by eccentricity of the registration roller 9 can also be decreased, so that higher precision is realized.

Although the first paper passage sensor 23 is disposed downstream from the registration roller 9 in the embodiment, it may be disposed upstream from the registration roller 9. However, to control the paper transport speed, it is necessary to previously grasp the timing at which the image 22 on the intermediate transfer belt 6 arrives at the transfer position. Thus, the patch sensor 20 and the first and second paper passage sensors 23 and 24 need to be placed so that a determination as to whether or not the sensor is turned on is made in the order of the patch sensor 20, the first paper passage sensor 23, and the second paper passage sensor 24.

By the way, as speeding up the paper transport speed, miniaturization of the image formation system, and the like move, the required time between paper being sensed by the first paper passage sensor 23 and arriving at the image transfer position is shortened, thus the speed reduction timing adjustment area E for reducing the paper transport speed (see FIG. 5) is limited drastically. As speeding up the paper transport speed, paper transport error sources, such as a slip phenomenon, increase, thus variations in the timing at which paper is sensed by the first paper passage sensor 23 also grow. Then, the timing at which paper is sensed by the first paper passage sensor 23 becomes ahead of the allowable time corresponding to the adjustment area E or becomes behind the allowable time; it is feared that the paper arrival timing may be unable to be adjusted sufficiently.

Figure 6A:
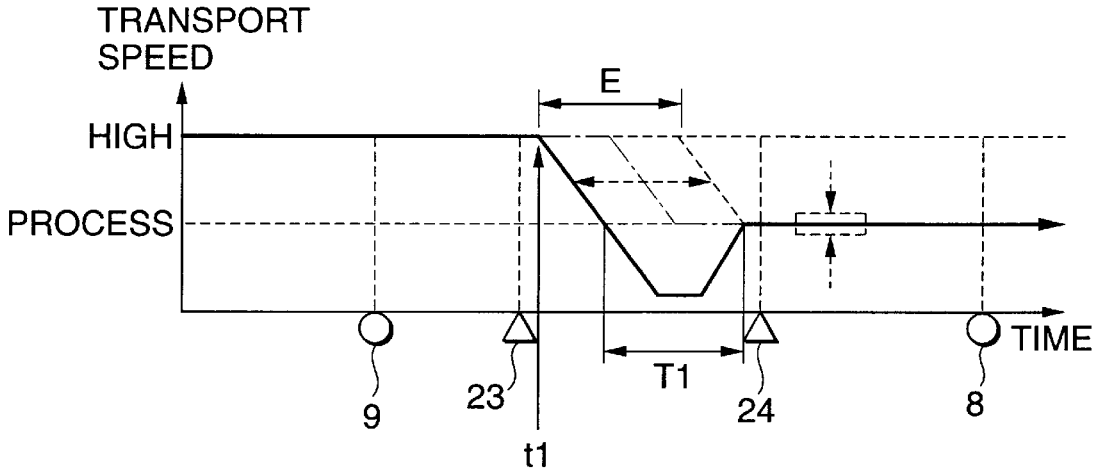
FIGS. 6A and 6B are charts describing another control mode of paper transport speed.
Figure 6B:
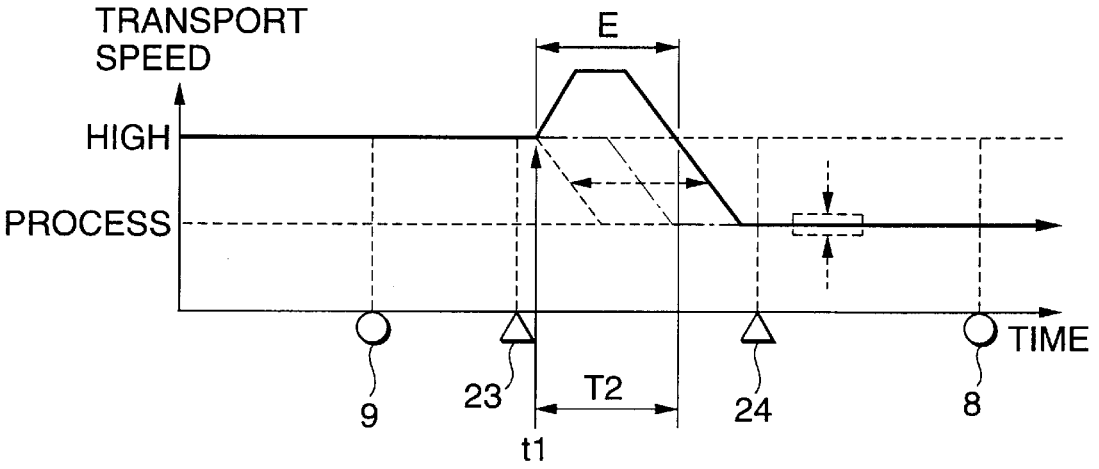

To cope with the situation, a control mode as shown in FIG. 6A and 6B may be adopted. That is, if the first paper passage sensor 23 senses passage of paper at earlier timing than the stipulated allowable time, the paper transport speed is reduced at timing t1, then once to lower speed than the process speed, hen is restored to the process speed, as shown in FIG. 6A. In contrast, if the first paper passage sensor 23 senses passage of paper at timing exceeding the stipulated allowable time, the paper transport speed is increased to a higher level than the high-speed level at timing t1, then is restored to the process speed, as shown in FIG. 6B.

At the time, time T1 for which the paper transport speed is held at lower speed than the process speed is set depending on the extent to which paper passage is sensed at early timing relative to the stipulated allowable time. Similarly, time T2 for which the paper transport speed is held at higher speed than the high-speed level is set depending on the extent to which paper passage is sensed at late timing relative to the stipulated allowable time.

Such a control mode is adopted, whereby the paper arrival timing at the image transfer position can be adjusted in a wider range without enlarging the adjustment area E. Thus, the control mode enables speeding up the paper transport speed and miniaturization of the image formation system.

In this connection, the paper arrival timing at the image transfer position can also be adjusted by making the paper transport speed change timing constant and adopting the control mode as shown in FIGS. 6A and 6B.

Figure 7:
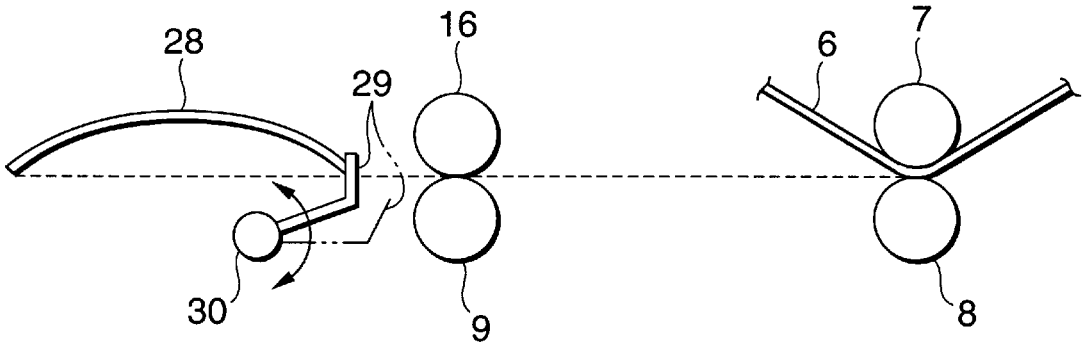
FIG. 7 is an illustration to describe another embodiment of an image formation system according to the invention.

FIG. 7 is an illustration to describe another embodiment of an image formation system according to the invention.

In the figure, a gate member 29 is disposed upstream from a registration roller 9. The gate member 29 is supported by a support shaft 30 so that it can swing in the arrow directions in the figure. As the support shaft 30 rotates, the gate member 29 operates between a position entering a paper transport passage (indicated by the solid line in the figure) and a position retracting therefrom (indicated by the dashed line in the figure).

At the actual paper transport time, the gate member 29 stands by for paper 28 sent from the upstream side in the position entering the paper transport passage. When the leading end of the paper 28 strikes against the gate member 29 and a predetermined loop is produced, the transport of paper 28 on the upstream side is temporarily stopped. At this time, the registration roller 9 rotates at a predetermined speed and a pinch roller 16 also rotates accordingly. In this state, if the gate member 29 is retracted from the paper transport passage, the leading end of the paper 28 is inserted into the space between the registration roller 9 and the pinch roller 16 by the push force of the loop, then is fed into an image transfer position as the registration roller 9 rotates.

Then, in the embodiment, the gate member 29 is retracted from the paper transport passage based on the arrival timing of an image 22 at the image transfer position found when a patch sensor 20 senses the position of the image 22 formed on an intermediate transfer belt 6 and the re-transport timing of paper 28 is controlled. Thus, the image 22 on the intermediate transfer belt 6 and the paper 28 transported by the registration roller 9 can be made to arrive at the image transfer position at ideal timing as in the above-described embodiment.

Figure 8:
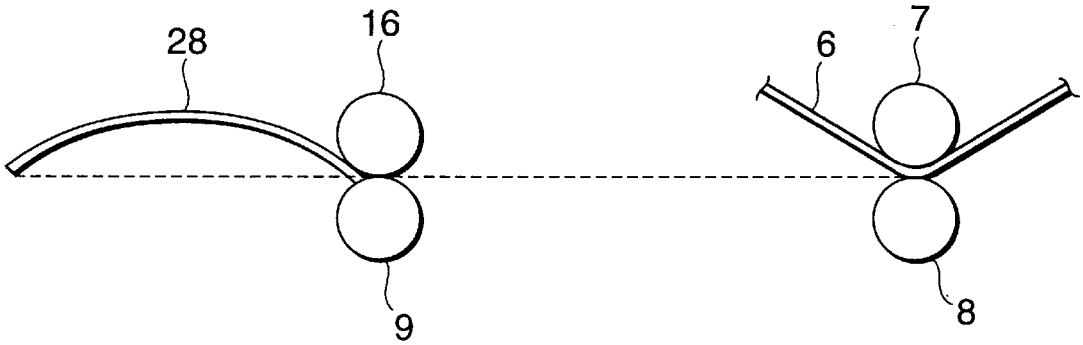
FIG. 8 is an illustration to describe a modification of stop means.

The unit temporarily stopping the paper 28 is not limited to the unit with the gate member 29; for example, as shown in FIG. 8, the following unit may be adopted: The registration roller 9 and the pinch roller 16 are stopped before arrival of paper 28. The paper 28 is temporarily stopped with the paper 28 striking against the space between the rollers, and drive of the registration roller 9 is started based on the timing at which the image 22 on the intermediate transfer belt 6 arrives at the transfer position, thereby adjusting the re-transport timing of the paper 28.

As described above, the image formation system according to the invention controls the paper transport speed based on the sense results of the sensors. Thus, if the image carry belt expands or contracts, the image formation system can cause an image and paper to arrive at the image transfer position of the transfer unit at good timing and can transfer the image to any desired position on the paper with high accuracy.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modifications may be made thereto without departing from the spirit and scope of the invention.

What is claimed is:

1. An image formation system, comprising:

paper transport means for transporting paper along a paper transport passage;

image formation means for forming an image on an image carry belt;

image sense means for sensing a position of the image formed on the image carry belt;

transfer means for transferring the image formed on the image carry belt to the paper transported by said paper transport means;

paper passage sense means for sensing paper passage on the paper transport passage, said paper passage sense means being disposed upstream from a position where the image is transferred by said transfer means; and control means for controlling paper transport speed of said paper transport means based on the sense results of said image sense means and said paper passage sense means, wherein said control means controls the paper transport speed of said paper transport means by one of: adjusting timing at which the paper transport speed of said paper transport means is changed from a high-speed level faster than process speed at image transfer time to the process speed, and varying the paper transport speed of said paper transport means between a high-speed level faster than process speed at image transfer time and a low-speed level slower than the process speed.

2. The image formation system as claimed in claim 1, wherein said control means calculates timing at which the image formed on the image carry belt arrives at the transfer position based on the sense result of said image sense means, and controls the paper transport speed of said paper transport means in response to the calculated image arrival timing.

3. The image formation system as claimed in claim 1, further including:

another paper passage sense means for sensing paper passage on the paper transport passage, said another paper passage sense means being disposed between the image transfer position and said paper passage sense means, wherein said control means finely adjusts the paper transport speed of said paper transport means based on the sense result of said another paper passage sense means after the adjustment of the paper transport speed of said paper transport means based on the sense result of said paper passage sense means.

4. The image formation system as claimed in claim 1, wherein a distance between the position of said image sense means and the image transfer position of said transfer means is set to an integral multiple of a peripheral length of a drive roller for driving the image carry belt.

5. The image formation system as claimed in claim 1, wherein a distance between the position of said paper passage sense means and the image transfer position of said transfer means is set to an integral multiple of a peripheral length of a paper feed roller for feeding paper into the image transfer position.

6. An image formation system, comprising:

paper transport means for transporting paper along a paper transport passage;

image formation means for forming an image on an image carry belt;

image sense means for sensing a position of the image formed on the image carry belt;

transfer means for transferring the image formed on the image carry belt to the paper transported by said paper transport means;

stop means for temporarily stopping the paper upstream from a position where the image is transferred by said transfer means;

paper passage sense means for sensing paper passage on the paper transport passage, the paper passage sense means being disposed downstream of the stop means; and control means for controlling paper re-transport timing of said stop means based on the sense result of said image sense means and said paper passage sense means.

7. An image formation system, comprising:

paper transport means for transporting paper along a paper transport passage;

image formation means for forming an image on an image carry belt;

image sense means for sensing a position of the image formed on the image carry belt;

transfer means for transferring the image formed on the image carry belt to the paper transported by said paper transport means;

paper passage sense means for sensing paper passage on the paper transport passage, said paper passage sense means being disposed upstream from a position where the image is transferred by said transfer means; and control means for controlling paper transport speed of said paper transport means based on the sense results of said image sense means and said paper passage sense means, wherein said control means controls the paper transport speed of said paper transport means by changing from a first high-speed level faster than process speed at image transfer time to a second high-speed level faster than said first high-speed level.

* * * * *